US006884091B1

(12) United States Patent
Rigby et al.

(10) Patent No.: US 6,884,091 B1
(45) Date of Patent: Apr. 26, 2005

(54) ELECTRICAL CONNECTOR ASSEMBLY

(75) Inventors: William J. Rigby, Somis, CA (US); Scott S. Blaise, Camarillo, CA (US)

(73) Assignee: Component Equipment Company, Inc., Camarillo, CA (US)

( * ) Notice: Subject to any disclaimer, the term of this patent is extended or adjusted under 35 U.S.C. 154(b) by 0 days.

(21) Appl. No.: 10/828,053

(22) Filed: Apr. 19, 2004

(51) Int. Cl.[7] ..... H01R 4/58
(52) U.S. Cl. ..... 439/79; 439/737
(58) Field of Search ..... 439/65, 78, 737, 439/573, 79, 80

(56) References Cited

U.S. PATENT DOCUMENTS

| | | | | | |
|---|---|---|---|---|---|
| 3,544,952 | A | * | 12/1970 | Piaget | 439/564 |
| 3,829,815 | A | * | 8/1974 | Rutkowski | 439/101 |
| 3,927,925 | A | * | 12/1975 | Borsuk | 439/109 |
| 5,169,335 | A | * | 12/1992 | Sayre | 439/364 |
| 5,277,624 | A | * | 1/1994 | Champion et al. | 439/607 |
| 5,397,241 | A | * | 3/1995 | Cox et al. | 439/79 |
| 5,443,401 | A | * | 8/1995 | Champion et al. | 439/680 |
| 5,971,770 | A | * | 10/1999 | Richmond | 439/63 |
| 6,625,153 | B1 | * | 9/2003 | Liu | 370/395.1 |

* cited by examiner

*Primary Examiner*—Ross Gushi
*Assistant Examiner*—Phuongchi Nguyen
(74) *Attorney, Agent, or Firm*—Jack C. Munro

(57) ABSTRACT

A first embodiment of electrical connector assembly establishing direct power to a plug-in module which utilizes a female connector that is electrically connected to a pair of spaced apart buss bars. The female connector is mounted in a fixed position in conjunction with a backplane. A male connector, which has a pair of male pins, is electrically connected to the female connector with this male connector to then be electrically connected to a plug-in module. A second embodiment of electrical connector assembly is for establishing a direct power supply to a mezzanine printed circuit board which is mounted parallel to but spaced from the plug-in module. The second embodiment of electrical connector assembly also utilizes a female connector that is connected to a pair of spaced apart buss bars. A male connector is then mounted in conjunction with the female connector with this male connector being mounted on the plug-in module. Mounted on the plug-in module is a female socket connector which is not electrically connected to the plug-in module. A pair of electrically conducting strips connect between the male connector and the female socket connector which is to be connected to appropriate pins mounted on a mezzanine board. Therefore, electrical power is transmitted directly from the buss bars to the mezzanine board rather than through the plug-in module.

9 Claims, 2 Drawing Sheets

ELECTRICAL CONNECTOR ASSEMBLY

BACKGROUND OF THE INVENTION

1. Field of the Invention

The field of this invention relates to electrical connectors and more particularly to electrical connectors that work in conjunction with a plug-in module of an electrical equipment housing and also in conjunction with a mezzanine board that is mounted in conjunction with the electrical equipment housing.

2. Description of the Related Art

Electrical equipment housings frequently have a plurality of plug-in modules located in a spaced apart stacked arrangement. Each plug-in module constitutes a printed circuit board which includes a series of ports. It is common that a typical plug-in module will have about thirty-two in number of such ports. Exterior electrical equipment will be plugged into these ports.

Electrical power must be supplied to the plug-in module. There is a need to construct a simplified plug assembly arrangement that will transmit this power directly to the plug-in module. This connector assembly must be small, compact, composed of few parts and can directly conduct a substantial amount of power.

Also, in conjunction with electrical equipment, there is commonly mounted a mezzanine board located directly adjacent a plug-in module and which is usually mounted between a pair of the plug-in modules. There is to be a mezzanine board for each plug-in module and the purpose of the mezzanine board is to increase the number of ports. The mezzanine board can increase the number of ports to ninety-six in number as opposed to thirty-two.

In the past, the power to the mezzanine board was supplied from the plug-in module. Therefore, the amount of power that was supplied to the mezzanine board was limited. For example, there may be four hundred amps supplied to the plug-in module. Of that four hundred amps only one-hundred eighty amps could be supplied to the mezzanine board which would limit the number of ports that could be utilized on the mezzanine board. It would be desirable to find some way to supply the four hundred amps also to the mezzanine board, the same as the plug-in module.

SUMMARY OF THE INVENTION

A first basic embodiment of electrical connector assembly of the present invention is to establish a direct power supply to a plug-in module from a pair of buss bars. Each buss bar is connected to a standoff with the standoff being mounted on a backplane. A female connector, which has a pair of terminals, is electrically connected to a standoff, with this female connector being fixedly mounted against the front surface of the backplane. A male connector, which has a pair of male pins, is electrically connected to the female connector. Each male pin of the male pins is electrically connected to a socket of the female connector and also is electrically connected to the plug-in module.

A further embodiment of the present invention is where the first basic embodiment is modified by having the terminals of the female connector to each include a tapered collar which is to be wedged within a hole formed in the backplane to tightly mount the female connector to the backplane.

A further embodiment of the present invention is where the first basic embodiment is modified by the female connector being constructed primarily of rigid, electrically insulative material.

A further embodiment of the present invention is where the first basic embodiment is modified by the male connector being constructed primarily of rigid, electrically insulative material.

A second basic embodiment of the present invention comprises an electrical connector assembly for the purpose of establishing a direct power supply to a mezzanine printed circuit board which is mounted in close proximity to a plug-in module. There is utilized a pair of spaced apart buss bars with each buss bar being connected to a standoff and each standoff is mounted on a backplane with the buss bars being located spaced but directly adjacent a rear surface of the backplane. A female connector, which has a pair of terminals, is electrically connected to the standoff off with this female connector being mounted directly against the front surface of the backplane. Each terminal of the female connector electrically connects with a separate socket. A male connector is used, which has a pair of male pins, with a single male pin to connect with a socket. Included within the male connector are a pair of connecting strips which are to electrically conduct the power from the buss bars exteriorly of the male connector and into a female socket connector. The mezzanine board is to directly connect with this female socket connector so the electrical power is transmitted directly from the buss bars to the mezzanine board and not being conducted through the plug-in module.

A further embodiment of the present invention is where the second basic embodiment is modified by defining that the mezzanine board is located parallel to but spaced from the plug-in module.

A further embodiment of the present invention is where the terminals of the female connector are each defined to have a tapered annular collar with each tapered annular collar to be wedged tightly within a hole formed within the backplane thereby rigidly mounting the female connector to the backplane.

A further embodiment of the present invention is where the second basic embodiment is modified by having the female connector being constructed primarily of a rigid electrically insulative material.

A further embodiment of the present invention is where the second basic embodiment is modified by having the male connector being constructed primarily of a rigid electrically insulative material.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
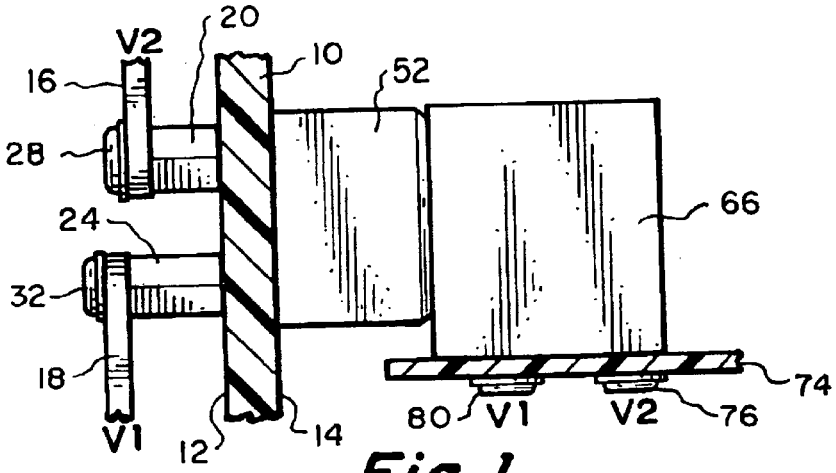
FIG. 1 is a side elevational view of the exterior of a first embodiment of electrical connector assembly of the present invention showing such being connected between buss bars and a plug-in module.

Referring particularly to the drawings, there is shown a backplane 10. Backplane 10 comprises a vertical supporting wall which would be located within a cabinet, which is not shown. The backplane 10 has a rear surface 12 and a front surface 14. The backplane 10 is basically of sheet material construction constructed of a material to be electrically insulative. A typical material might be of fiberglass, plastic or even a paper composition. The rear surface 12 is parallel to the front surface 14.

Mounted directly adjacent the rear surface 12, and spaced therefrom, are a pair of buss bars 16 and 18. The buss bars 16 and 18 are basically identical and each is to be connected with a source (not shown) of electrical energy. Buss bar 16 receives a voltage defined as V2 with buss bar 18 receiving a voltage defined as V1.

Buss bar 16 is connected to a fastener, which is called a standoff 20. The standoff 20 generally is in the form of a hollow sleeve which has a threaded interior hole 22. Buss bar 18 is connected to a standoff 24 which also has a threaded interior hole 26. A fastener 28, which has a threaded end 30, is used to securely attach the buss bar 16 to the standoff 20 with the threaded end 30 engaging with the threaded hole 22. In a similar manner, a fastener 32 is used to secure the buss bar 18 to the standoff 24 with the threaded end 34 being threadably secured with threaded interior hole 26. The standoff 20 has an outer threaded end 36 and standoff 24 has an outer threaded end 38. The threaded end 36 threadably connects with a sleeve 40. In a similar manner, the outer threaded end 38 connects with a sleeve 42. Sleeves 40 and 42, threaded ends 36 and 38, as well as standoffs 20 and 24 are all capable of conducting electricity. Sleeve 40 includes an annular exteriorly tapered collar 44. The sleeve 42 includes a similar collar 46 which is also exteriorly tapered. There is provided in the backplane 10 a pair of holes 48 and 50 which are of the same size, usually about one-quarter to three eighths inches in diameter. Collar 44 is wedged tightly within hole 48. Collar 46 is wedged tightly within hole 50. Sleeves 40 and 42 are integrally mounted within a female connector housing 52 which is usually constructed of a plastic material. The sleeve 40 is mounted within through hole 54 of the female connector housing 52, and sleeve 42 is mounted within through hole 56 of the female connector housing 52.

The sleeve 40 includes a socket 58. Sleeve 42 includes a socket 60. A pin 62 is to be inserted in snug contact with the socket 58. In a similar manner, a pin 64 is to be inserted in snug contact with the socket 56. The pins 62 and 64 are embedded within a male connector housing 66. The male connector housing 66 is basically rectangular in shape as is also the female connector housing 52. The male connector housing 66 is larger in size than the female connector housing 52. The male connector housing 66 will normally be constructed of an electrically insulative material again with plastic being preferred. Within the housing 66, the pin 62 is integrally connected to a right angle extension 70. In a similar manner, the pin 64 is integrally connected to a right angle extension 72. Right angle extension 70 is electrically connected to a plug-in module 74. The plug-in module 74 constitutes a printed circuit board on which are mounted numerous electronic components, which are not shown. The plug-in module 74 is capable of being plugged into a receiving area within the cabinet, which is also not shown. The plug-in module 74 will include a plurality of accessible ports, usually there being at least thirty-two in number. A bolt fastener 76 is threadably received within an interior threaded hole 78 formed within right angle extension 70. The fastener 76 functions to tightly secure the plug-in module 74 to the right angle extension 70. In a similar manner, a bolt fastener 80 is threadably received within a threaded hole 82 formed within right angle extension 72. The fastener 80 functions to securely bind the plug-in module 74 to the right angle extension 72. It can thus be seen that voltage V1 is conducted directly to fastener 80 and hence to plug-in module 74. It can thus also be seen that voltage V2 is conducted directly to fastener 76 and hence to plug-in module 74.

Figure 2:
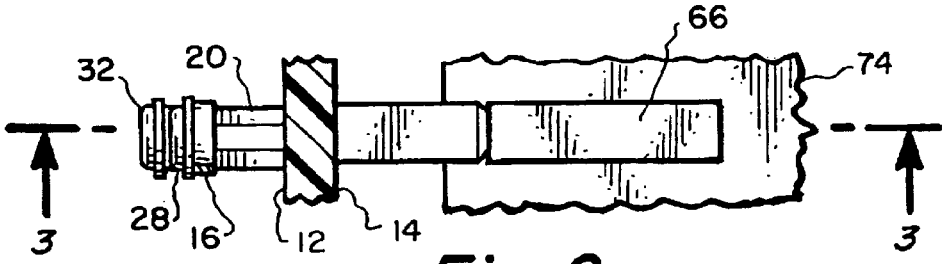
FIG. 2 is a top plan view of electrical connector assembly as shown in FIG. 1.
Figure 3:
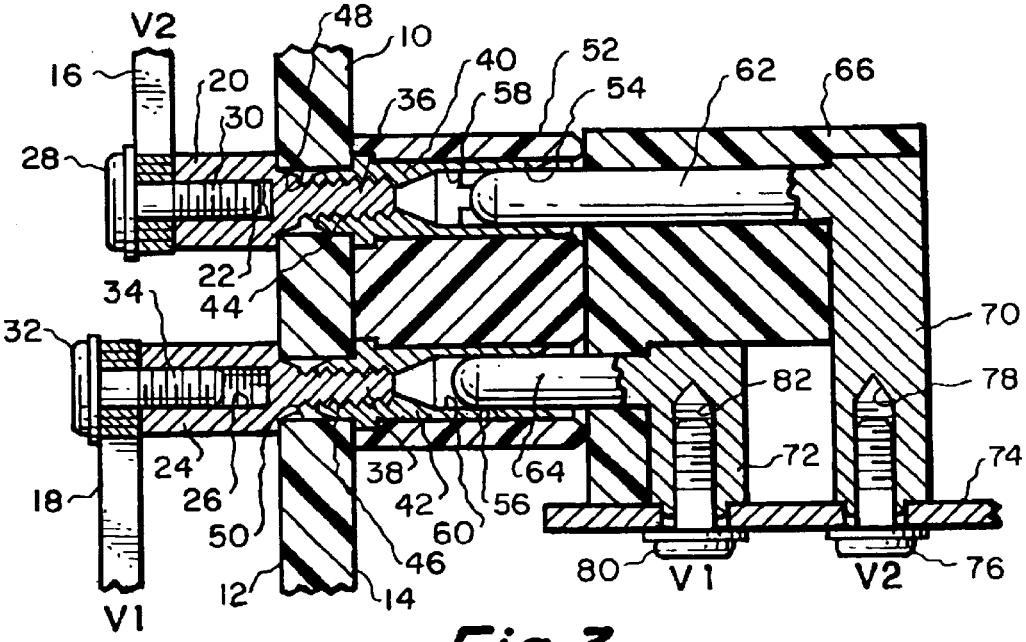
FIG. 3 is a longitudinal cross-sectional view of the first embodiment of electrical connector assembly of the present invention taken along line 3—3 of FIG. 2.
Figure 4:
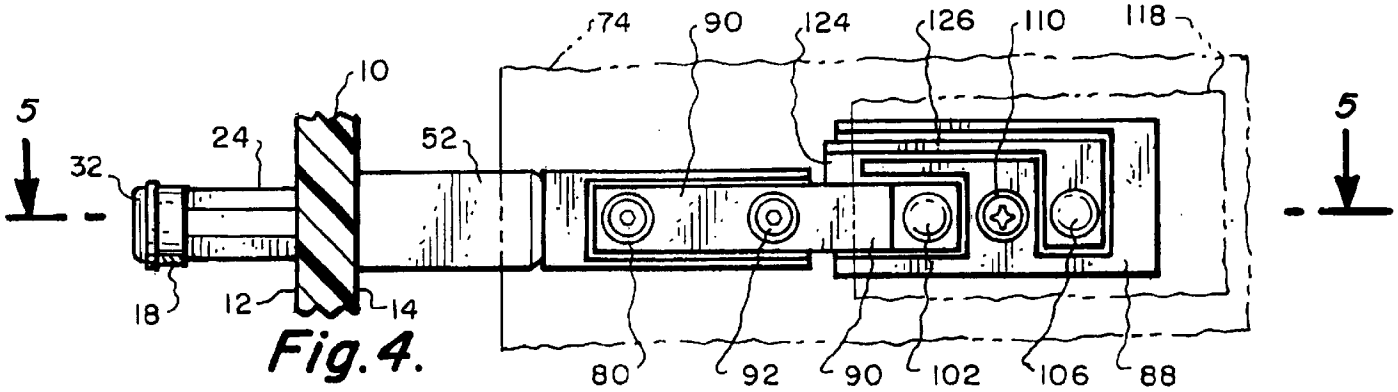
FIG. 4 is a top plan view of a second embodiment of electrical connector assembly of the present invention.
Figure 5:
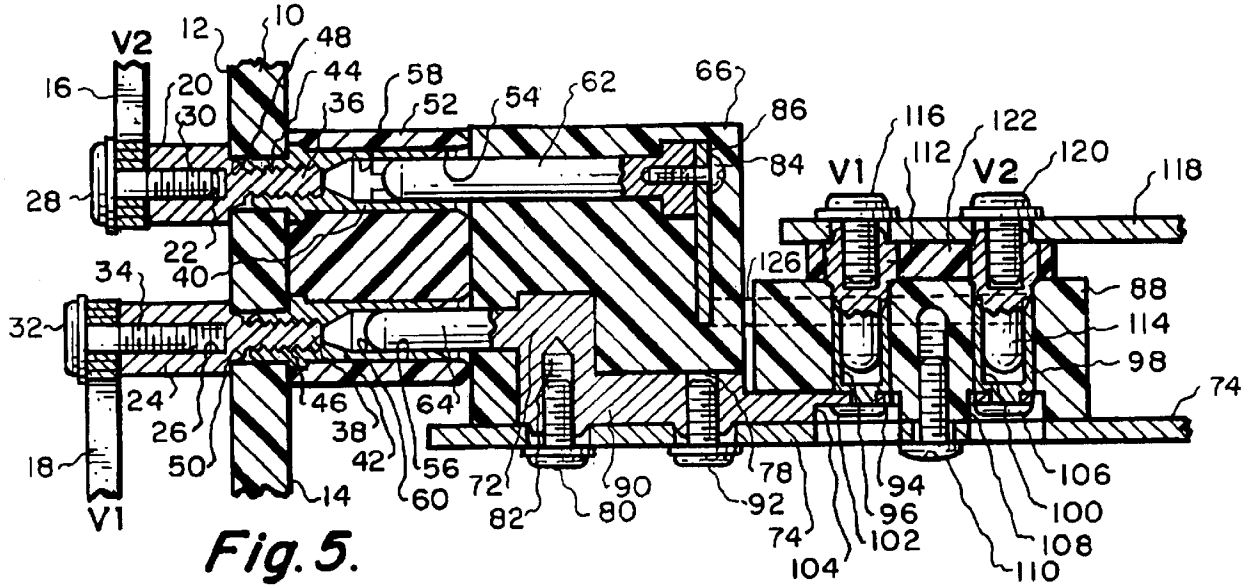
FIG. 5 is a longitudinal cross-sectional view taken along line 5—5 of FIG. 4 of the second embodiment of electrical connector assembly of the present invention.

Referring particularly to FIGS. 4 and 5, there is shown the second embodiment of this invention with the first embodiment having been shown and described in relation to FIGS. 1–3. Within the second embodiment in FIGS. 4 and 5, there is utilized the same buss bars 16 and 18, the same standoffs 20 and 24, the same backplane 10, the same female connector housing 52 and a similar male connector housing 66. However, instead of the pin 62 being connected to right angle extension 70, the pin 62 is electrically connected by means of a bolt fastener 84 to a connecting strip 86. This connecting strip 86 is in part embedded within the housing 66 with a portion of the connecting strip 86 extending at a right angle exteriorly of the housing 66 and embedded within a female socket connector housing 88. The pin 64 is connected in a similar manner to a right angle extension 72 which is securely mounted by fastener 80 to the plug-in module 74. However, the right angle extension 72 is integrally connected to a connecting strip 90 which extends exteriorly of the housing 76. This connecting strip 90 is fixedly mounted to the plug-in module 74 by means of a bolt fastener 92. The connecting strip 90 is also embedded within the female socket housing 88.

The connecting strip 90 electrically connects with a sleeve 94 which is embedded within the housing 88. The sleeve 94 includes a socket 96. The connecting strip 86 electrically connects with a sleeve 98 which is also embedded within the housing 88 and includes a socket 100. Sleeve 96 has a inner end which is closed by a cap 102. The cap 102 is mounted within a recess 104 formed within the housing 88. In a similar manner, the inner end of the socket 100 is closed by means of a cap 106 which is mounted onto the sleeve 98. The cap 106 is mounted within a recess 108 formed within the housing 88.

When the housing 88 is fixedly secured to the plug-in module 74 by means of bolt fastener 110, a pin 112 is snugly inserted within the socket 96 electrically engaging with the sleeve 94. A pin 114 is inserted within the socket 100 and electrically engages with the sleeve 98. Pin 112 is electrically mounted by means of a bolt fastener 116 to a mezzanine board 118. In a similar manner, the pin 114 is electrically connected by means of a bolt fastener 120 to the mezzanine board 118. In between the housing 88 and the mezzanine board 118 is a spacer 122 which is to locate the mezzanine board 118 in the proper parallel spaced relationship relative to the plug-in module 74. The spacer 122 is connected to the electrically insulative material. It is to be understood that bolt fasteners 116 and 120 are to be connected to appropriate electrical circuitry (not shown) which is included within mezzanine board 118.

The connecting strip 90 is, in essence, a straight member that connects directly to the sleeve 94. However, it is necessary for the connecting strip 86 to be contorted and include a right angled bend 124 and then a straight section 126 in order to pass by and not come into contact with the sleeve 94. The electrical separation has to be provided between the straight section 126 of the connecting strip 86 and the sleeve 94 with it only being connected to the sleeve 98.

It can thus be seen, by noting particularly in FIG. 5, that the voltage V1 from the buss bar 18 is conducted through the standoff 24, through the sleeve 42, through the pin 64, through the right angle extension 72, through the connecting strip 90, to the sleeve 94 and hence to the pin 112, and to the mezzanine board 118. In a similar manner, the voltage V2 from the buss bar 16 is conducted through standoff 20, to the sleeve 40, to the pin 62, to the connecting strip 86, through right angle bend 124, to the straight section 126, to the sleeve 98, to the pin 114, and to the mezzanine board 118. Instead of the power to the mezzanine board 118 being supplied from a plug-in module 74, it is supplied directly from the power source, which is connected to the buss bars 16 and 18.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. An electrical connector assembly for a establishing a direct power supply to a plug-in module comprising:

a pair of spaced apart buss bars, each buss bar of said bus barrs being connected to a standoff, each standoff being mounted on a backplane with said buss bars located spaced apart directly adjacent a rear surface of said backplane;

a female connector having a pair of terminals, each terminal of said pair of terminals to electrically connect with a said standoff and said female connector being mounted against a front surface of said backplane, each said terminal electrically connecting with a separate socket; and a male connector having a pair of male pins, each male pin of said male pins being electrically connected to a said socket and to said plug-in module, whereby power to said plug-in module is supplied directly from said buss bars.

2. The electrical connector assembly as defined in claim 1 wherein:

said backplane having a pair of holes, a said terminal to be mounted within said hole, said terminal having a tapered collar, said tapered collar forming a tight wedging connection with said hole.

3. The electrical connector assembly as defined in claim 1 wherein:

said female connector being constructed primarily of a rigid electrically insulative material.

4. The electrical connector assembly as defined in claim 1 wherein:

said male connector being constructed primarily of a rigid electrically insulative material.

5. An electrical connector assembly for establishing a direct power supply to a mezzanine printed circuit board mounted in close proximity to a plug-in module comprising:

a pair of spaced apart buss bars, each buss bars of said buss bars being connected to a standoff, each standoff being mounted on a backplane with said buss bars being located spaced but directly adjacent a rear surface of said backplane;

a female connector having a pair of terminals, each terminal of said pair of terminals to electrically connect with a said standoff and said female connector being mounted against a front surface of said backplane, each said terminal electrically connecting with a separate socket; and a male connector having a pair of male pins, each male pin of said male pins being mounted on said plug-in module, each said male pin electrically connecting to a separate connecting strip with there being a pair of said connecting strips, each said connecting strip extending exteriorly of said male connector and electrically connecting with a separate female socket of a female socket connector, said female socket connector being mounted on said plug-in module, said mezzanine board being electrically connected to said female socket.

6. The electrical connector assembly as defined in claim 5 wherein:

said mezzanine board being located parallel to but spaced from said plug-in module.

7. The electrical connector assembly as defined in claim 5 wherein:

said backplane having a pair of holes, a said terminal to be mounted within said hole, said terminal having a tapered collar, said tapered collar forming a tight wedging connection with said hole.

8. The electrical connector assembly as defined in claim 5 wherein:

said female connector being constructed primarily of a rigid electrically insulative material.

9. The electrical connector assembly as defined in claim 5 wherein:

said male connector being constructed primarily of a rigid electrically insulative material.

* * * * *